US005155459A

United States Patent [19]

Schmid et al.

[11] Patent Number: 5,155,459

[45] Date of Patent: Oct. 13, 1992

[54] ELECTROMAGNETIC RELAY

[75] Inventors: Hans-Dieter Schmid; Anton Frenznick; Dieter Mach, all of Nürnberg; Karl Brandsch, Stein; Volker Busch, Oberasbach; Manfred Mitsch, Ansbach; Theodor Strum, Sachsen, all of Fed. Rep. of Germany

[73] Assignee: Robert Bosch GmbH, Stuttgart, Fed. Rep. of Germany

[21] Appl. No.: 689,233

[22] PCT Filed: Aug. 16, 1989

[86] PCT No.: PCT/DE89/00537

§ 371 Date: Jun. 6, 1991

§ 102(e) Date: Jun. 6, 1991

[87] PCT Pub. No.: WO90/06588

PCT Pub. Date: Jun. 14, 1990

[30] Foreign Application Priority Data

Oct. 12, 1988 [DE] Fed. Rep. of Germany ..... 3841667

[51] Int. Cl.[5] ..... H01H 67/02

[52] U.S. Cl. ..... 335/128; 335/86; 335/78

[58] Field of Search ..... 355/78-86, 355/124, 128, 202

[56] References Cited

U.S. PATENT DOCUMENTS 3,068,335 12/1962 Gregg .

4,972,166 11/1990 Mitsch et al. ..... 335/128

*Primary Examiner*—Lincoln Donovan

*Attorney, Agent, or Firm*—Michael J. Striker

[57] ABSTRACT

An electromagnetic relay for consumers with a high switch-on current peak has a main contact and a preliminary contact on legs which extend near one another. The legs carrying the main and preliminary contacts are connected at both sides with another leg via connecting webs and have each a stretch zone between a common connecting yoke of the legs and the connecting webs. At the stretch zones the main and preliminary contacts are adjusted independently of one another by means of squeezing the material of the contact carrier.

2 Claims, 1 Drawing Sheet

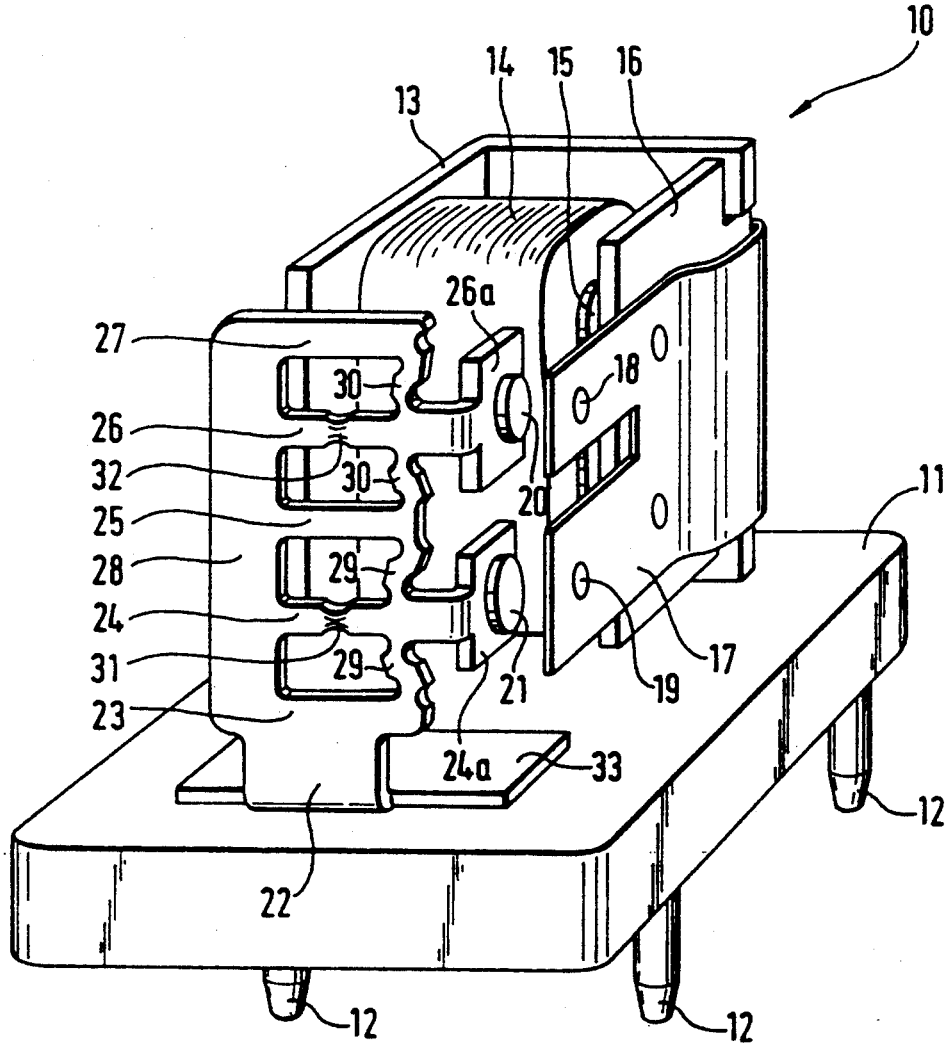
10
14
15
16
13
26a
27
30
18
26
32
30
20
11
25
28
29
24
17
31
29
21
19
23
24a
33
12
22
12
12

ELECTROMAGNETIC RELAY

BACKGROUND OF THE INVENTION

The invention relates to an electromagnetic relay comprising a base plate and contact and connection parts fastened on the latter, as well as a magnet yoke which carries a coil core for receiving a relay winding and a hinged armature which is swivelably supported at the front side of the coil core and is provided with at least one switching contact which cooperates with a stationary working contact of a contact carrier fastened on the base plate.

In such a relay, which is known from DE-PS 36 40 997, the switching contact of the relay is adjusted by means of a squeezing process at a central leg of the contact carrier, the relay contact being fastened at the free end of the latter. The squeezing is effected in a stretch zone of the leg which is arranged between connecting webs at adjacent legs, which connecting webs project out symmetrically at both sides, and a yoke of the contact carrier which connects the three legs.

However, the use of such relays for switching on electromagnetic consumers such as electric motors, magnetic valves and the like is only possible to a limited extent because of the occurring high switch-on currents, since the silver-nickel alloy of the relay contacts causes a relatively low transition resistance, but leads to rapid wear of the contacts at high current loads. Therefore, with larger consumers or consumers with high switch-on current intensities it is known in motor vehicles to use relays with a main contact and preliminary contact according to DE-OS 30 08 089, wherein the preliminary contact is produced from a material which is resistant to burning, e.g. tungsten, for absorbing the high switch-on current; however, this material has a considerably higher transition resistance than the material of the main contact. In such relays, the advance or lead of the preliminary contact, as well as the burning reserve and contact pressure of the preliminary and main contacts, must be adjusted independently of one another. Until now, adjustment screws were normally arranged at the relay for this purpose. These adjustment screws necessitate costly production, assembly and adjustment and, moreover, must be secured after the adjusting process by means of glue or a weld joint. It is further known to adjust the main and preliminary contacts of such relays independently of one another at a contact carrier by means of a pressing or notching adjustment, as is known from DE-OS 30 12 354 (R. 6210). However, a disadvantage consists in that the contacts can be placed in a slanted or lopsided position by means of the notching or pressing process as a result of irregular material joints, which can lead to increased burning of the contacts.

SUMMARY OF THE INVENTION

Advantages of the Invention

The present solution endeavors to adjust the main and preliminary contacts of power relays in the simplest, most exact and reliable manner possible independently of one another and in the most economical manner possible.

In keeping with these objects the relay according to the invention is characterized in that, in addition to the work contact serving as main contact, a preliminary contact cooperating with a second switching contact of the hinged armature is arranged at the angled end of another middle leg which is connected with an adjacent leg of the contact carrier in each instance via additional connecting webs, which project symmetrically at both sides, and the middle leg likewise comprises a stretch zone between the yoke and the connecting web.

The relay, according to the invention has the advantage that the lead of the preliminary contact relative to the main contact, i.e. the contact sequence, as well as the contact pressure and consequently the so-called burning reserve, can be adjusted very accurately, quickly and reliably independently of one another without the adjusted values changing subsequently, e.g. as a result of elastic deformations during a bending adjustment of the contact carrier. Another advantage consists in that the contact carrier can be produced without greater cost from a single stamped part which is to be anchored in a base plate together with the magnet yoke. Moreover, the connecting webs, which project symmetrically at both sides of the middle leg of the main and preliminary contacts, ensure that the main and preliminary contacts are stretched in a plane-parallel manner and in such a way that they retain their angles.

Advantageous developments and improvements of these features are made possible by means of some additional steps. In order to increase the stability of the contact carrier it is advantageous if all legs of the contact carrier are rigidly connected with one another at their ends remote of the main and preliminary contacts via a common yoke. Moreover, it is advisable to arrange only one additional leg between the legs with the main contact and the secondary contact, the connecting webs lying between the legs of the main and secondary contact being connected with the additional leg.

BRIEF DESCRIPTION OF THE DRAWING

An embodiment example of the invention is shown in the drawing which shows a power relay for motor vehicles with a preliminary and main contact.

DESCRIPTION OF THE PREFERRED EMBODIMENT

The drawing shows a power relay 10 for electrical d.c. consumers with high starting current, as is required particularly in motor vehicles for turning on and off electromagnetic valves and electric motors, e.g. for pumps and spark plugs. The relay is provided with a base plate 11 consisting of insulating material in which a plurality of connection parts 12 are fastened. The connection parts 12 project downward out of the base plate 11. The base plate 11 also carries an L-shaped magnet yoke 13 which is anchored at a front side with fastening tabs in corresponding pockets of the base plate 11. A relay winding 14 is arranged on a coil core 15 which is riveted to the magnet yoke 13 by its rear end. A hinged armature 16 which is swivelably supported at the magnet yoke 13 by its rear end is arranged in front of the free end of the coil core 15. A leaf spring 17 is riveted on the hinged armature 16. It front end which projects over the hinged armature 16 carries two switching contacts 18 and 19 lying next to one another at a distance, only the areas of the latter 18 and 19 which are riveted with the leaf spring 17 are shown in the drawing. The other end of the leaf spring 17 is guided around the bearing of the hinged armature 16 at the magnet yoke 13 and is fastened at the rear of the magnet yoke 13 with corresponding pretensioning in order to achieve a restoring force for the hinged armature 16. The leaf spring 17 serves, in addition, to supply current for the switching contacts 18, 19. Alternatively, the restoring force for the hinged armature 16 can also be produced by means of a helical tension spring which is suspended at a projection, not shown, of the hinged armature 16 and the magnet yoke 13. In this case, the shortened rear end of the leaf spring 17 is connected with one of the connection parts 12 via a copper stranded conductor which is welded on.

The switching contact 18 at the leaf spring 17 of the hinged armature 16 cooperates with a stationary preliminary contact 20 and the switching contact 19 cooperates with a stationary main contact 21 which forms the working contact of the relay. The preliminary contact 20 and the switching contact 18 cooperating with it are produced from a burning-resistant material for absorbing the high inrush current, whereas the main contact 21 and the switching contact 19 cooperating with it consist of a silver-nickel alloy with low transition resistance for absorbing the constant current. When the relay 10 is switched on, the hinged armature 16 is drawn toward the coil core 15 by means of the magnetic field of the relay winding 14, wherein the preliminary contact 20 and the main contact 21 are closed one after the other. When these contacts are closed the preliminary contact 20 must lead the main contact 21 to the extent that the inrush current is taken over to a sufficient degree by the preliminary contact 20. Moreover, the contact pressure at the main contact 21 must be adjusted for the so-called burning reserve. The preliminary contact 20 and main contact 21 are arranged at a common contact carrier 22 which is likewise fastened on the base plate 11 and securely connected with one of the connection parts 12.

In order to adjust the main contact 21 and the preliminary contact 20 independently from one another, the contact carrier 22 is provided, in an area extending in the movement direction of the hinged armature 16, with legs 23 to 27 which extend adjacent to one another at a distance and proceed from a common yoke 28. The second leg 24 carries the main contact 21 at its angled free end **24*a* and the fourth leg 26 carries the preliminary contact 20 at the free angled end 26*a*. The leg 24 with the main contact 21 is connected with the adjacent legs 23 and 25 by means of connecting webs 29 which project symmetrically at both sides, which legs 23 and 25 prevent a slanting of the contact during the adjustment of the main contact 21. In the same way, the leg 26 with the preliminary contact 21 is connected with the adjacent legs 25 and 27 by means of connecting webs 30 which project symmetrically at both sides. A stretch zone 31 and 32, respectively, is provided between the connecting webs 29 and 30 and the yoke 28 of the contact carrier 22 at the legs 24 and 26, respectively, carrying the main contact 21 and the preliminary contact 20, respectively. During the contact adjustment of the relay 10, the leg 24 carrying the main contact 21 is first squeezed in its stretch zone 31 with pressing pliers, so that the angled end 24*a* of the leg 24 is exactly guided by means of the connecting webs 21 and raised until the required contact pressure and the required burning reserve are adjusted when the hinged armature 16 is attracted. A quick, accurate and permanent contact adjustment is accordingly effected by means of the persisting deformation in the stretch zone 31. Independently of this, the leg 26 carrying the preliminary contact 20 is then squeezed in its stretch zone 32 with the pressing pliers and the angled end 26*a* is raised until the preliminary contact 20 leads the main contact 21 by a desired amount of approximately 0.1 mm when the relay contacts are closed. This lead can advisably be predetermined relative to the main contact 21 by means of a correspondingly thicker preliminary contact 20, so that the leg ends 26*a* and 24*a* can be angled at the same height during the production of the contact carrier 22. Beyond this, an excessive squeezing in the stretch zone 32 of the leg 26** can accordingly be prevented.

In the embodiment example, all legs 23 to 27 of the contact carrier 22 are rigidly connected with one another at their ends remote of the main contact 21 and preliminary contact 20 via the common yoke 28, wherein this yoke 28 is fastened on the base plate 11 via a foot plate 33 of the contact carrier 22 so as to be stable enough that the yoke 28 cannot give during the adjusting process. The lower leg 23 is kept relatively short. Depending on the adjustment of the hinged armature 16, the contact carrier 22 can also be fastened at the base plate 11 or at other supporting parts of the relay by another area, e.g. the yoke area. In so doing, it is important only that the main and preliminary contacts be adjustable independently of one another by means of the stretch zones 31 and 32 of the legs 24, 26 carrying them, wherein the lateral connecting webs 29, 30 serve for lateral guidance and also partially for conducting current. The connecting webs 29, 30 lying between the legs 24 and 26 with the main contact 21 and the preliminary contact 20 are advisably connected with a common adjacent leg 25.

We claim:

1. An electromagnetic relay, comprising a base plate; contact and connection parts fastened on said base plate; a magnet yoke; a coil core adapted to receive a relay winding and carried by said magnet yoke; a hinged armature swivelably supported at a front side of said coil core and provided with two switching contacts; a contact carrier mounted on said base plate and having a work contact serving as a main contact and cooperating with one of said switching contacts of said hinged armature and also a preliminary contact cooperating with the other of said switching contacts of said hinged armature, said contact carrier having at least three legs at a distance from one another, one of said legs carrying said work contact and being connected with other legs by connecting webs which project symmetrically at both sides of said one leg, another of said legs carrying said preliminary contact and connected with the other legs by means of connecting webs which project symmetrically at both sides of said another leg, each of said one and another legs having a stretch zone between said yoke and said connecting webs for adjusting a respective one of said contacts, each of said one and another leg having an angled end, said work contact being arranged on said angled end of said one leg, while said preliminary contact is arranged on said angled end of said another leg, said contact carrier having a common yoke and an end which is removed from said main contact, said legs of said contact carrier being rigidly connected with one another by said common yoke at said end.

2. An electromagnetic relay as defined in claim 1, wherein said legs of said contact carrier include a leg located between said one leg and said adjacent leg, said connecting webs including connecting webs which are located between said one leg and said adjacent leg and connected with said leg located between said one leg and said adjacent leg.

* * * * *